US008905248B1

(12) United States Patent
Wolski

(10) Patent No.: US 8,905,248 B1
(45) Date of Patent: Dec. 9, 2014

(54) WALL-MOUNTED BRACKET SUPPORT SYSTEM

(71) Applicant: Bruce Wolski, Longmont, CO (US)

(72) Inventor: Bruce Wolski, Longmont, CO (US)

( * ) Notice: Subject to any disclaimer, the term of this patent is extended or adjusted under 35 U.S.C. 154(b) by 0 days.

(21) Appl. No.: 14/042,790

(22) Filed: Oct. 1, 2013

(51) Int. Cl.

| | |
|---|---|
| ***A47F 5/08*** | (2006.01) |
| ***B60R 9/06*** | (2006.01) |
| *A47F 1/00* | (2006.01) |
| *A47B 43/00* | (2006.01) |
| *A47B 9/00* | (2006.01) |
| *A47B 3/00* | (2006.01) |
| *A47G 29/02* | (2006.01) |
| *E04G 3/20* | (2006.01) |

(52) U.S. Cl.
CPC ..... *B60R 9/06* (2013.01)
USPC ..... 211/90.03; 211/95; 211/187; 108/108; 108/179; 248/240; 248/250

(58) Field of Classification Search
USPC ..... 211/90.01–90.04, 95, 86.01, 134, 144, 211/186, 187; 108/108, 179, 134, 152; 248/235, 240, 241, 250
See application file for complete search history.

(56) References Cited

U.S. PATENT DOCUMENTS

| | | | | | |
|---|---|---|---|---|---|
| 143,228 | A | * | 9/1873 | Doyle | 248/240 |
| 203,649 | A | * | 5/1878 | Runton | 108/1 |
| 290,789 | A | * | 12/1883 | Nagele | 248/240.4 |
| 300,361 | A | * | 6/1884 | Hale | 108/177 |
| 317,242 | A | * | 5/1885 | Taten | 248/240 |
| 330,721 | A | * | 11/1885 | McBlair | 108/179 |
| 474,406 | A | * | 5/1892 | Ramsey | 182/62 |
| 479,424 | A | * | 7/1892 | Huff | 248/235 |
| 605,198 | A | * | 6/1898 | Elliot | 434/130 |
| 694,445 | A | * | 3/1902 | Timmons | 108/134 |
| 1,039,694 | A | * | 10/1912 | Burton | 108/163 |
| 1,197,891 | A | * | 9/1916 | Barnes | 108/134 |
| 1,259,532 | A | * | 3/1918 | Leach | 108/29 |
| 1,281,105 | A | * | 10/1918 | Unger | 211/164 |
| 1,576,227 | A | * | 3/1926 | Rundle | 248/240 |
| 1,667,657 | A | * | 4/1928 | Dobert | 211/99 |
| 1,826,469 | A | * | 10/1931 | Hunt et al. | 40/533 |
| 1,852,723 | A | * | 4/1932 | Orton et al. | 108/134 |
| 1,898,865 | A | * | 2/1933 | Balch | 108/134 |
| 2,179,273 | A | * | 11/1939 | Ponten et al. | 108/46 |
| 2,265,542 | A | * | 12/1941 | Nofzinger et al. | 248/241 |
| 2,290,535 | A | * | 7/1942 | Cavins | 182/186.9 |
| 2,485,201 | A | * | 10/1949 | Jewett | 211/96 |
| 2,521,899 | A | * | 9/1950 | Carlin | 242/596.3 |
| 2,633,998 | A | * | 4/1953 | Henrietta et al. | 211/104 |
| 2,637,445 | A | * | 5/1953 | Patterson | 108/59 |
| 2,639,817 | A | * | 5/1953 | Ehret | 108/152 |
| 2,649,972 | A | * | 8/1953 | Weil | 108/147.11 |
| 2,740,397 | A | * | 4/1956 | Schaefer | 126/505 |
| 2,746,664 | A | * | 5/1956 | Strmic | 182/156 |
| 3,184,200 | A | * | 5/1965 | McDonnell | 248/240 |
| 3,221,678 | A | * | 12/1965 | Doherty | 248/230.1 |
| 4,266,821 | A | | 5/1981 | Gillet | |
| 4,564,167 | A | | 1/1986 | Smith | |

(Continued)

*Primary Examiner* — Joshua J Michener
*Assistant Examiner* — Devin Barnett
(74) *Attorney, Agent, or Firm* — Kyle A. Fletcher, Esq.

(57) ABSTRACT

The wall mounted bracket support system includes a set of wall-based mounting brackets that are secured to a linear wall surface, and which enable an inner support assembly to attach, and hang there from. The inner support assembly is configured to secure and support an object thereon, and is able to attach to a swiveling tailgate support assembly or simply hang adjacent the linear wall surface.

9 Claims, 6 Drawing Sheets

(56) References Cited

U.S. PATENT DOCUMENTS

| | | | | | |
|---|---|---|---|---|---|
| 4,819,900 | A | * | 4/1989 | Funk | 248/244 |
| 4,854,456 | A | * | 8/1989 | Lee | 211/14 |
| 4,936,467 | A | * | 6/1990 | Bobeczko | 211/14 |
| 5,253,837 | A | * | 10/1993 | Loux | 248/250 |
| 5,257,701 | A | * | 11/1993 | Edelson | 211/149 |
| D349,680 | S | | 8/1994 | Powell | |
| 5,498,049 | A | | 3/1996 | Schlachter | |
| 5,592,887 | A | * | 1/1997 | Teng | 108/134 |
| 5,722,329 | A | * | 3/1998 | Weng | 108/47 |
| 5,871,105 | A | * | 2/1999 | Whitehead et al. | 211/14 |
| 5,964,492 | A | | 10/1999 | Lyon | |
| 6,170,724 | B1 | | 1/2001 | Carter | |
| 6,446,752 | B2 | * | 9/2002 | Philippe | 182/82 |
| 6,460,469 | B1 | * | 10/2002 | Dickinson et al. | 108/152 |
| 6,550,188 | B2 | * | 4/2003 | Bolinger et al. | 52/127.2 |
| 6,561,364 | B1 | * | 5/2003 | Brunsden | 211/90.01 |
| 6,666,153 | B2 | * | 12/2003 | Dickinson et al. | 108/152 |
| 7,073,867 | B2 | | 7/2006 | Huenke | |
| 8,210,365 | B2 | * | 7/2012 | Van Wyk | 211/85.7 |
| 8,226,184 | B2 | * | 7/2012 | Kang et al. | 312/408 |
| 8,281,967 | B2 | | 10/2012 | Evans | |
| 2006/0175493 | A1 | * | 8/2006 | Norman | 248/235 |
| 2008/0048081 | A1 | * | 2/2008 | Costa et al. | 248/241 |

* cited by examiner

WALL-MOUNTED BRACKET SUPPORT SYSTEM

CROSS REFERENCES TO RELATED APPLICATIONS

This non-provisional patent application is a continuation-in part of non-provisional patent application Ser. No. 13/937,380, which was filed on Jul. 9, 2013. This non-provisional patent application claims priority to said non-provisional patent application Ser. No. 13/937,380.

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of truck bed accessories, more specifically, a wall-mounted bracket assembly for storing an accessory for a truck bed or tailgate that is able to support an object thereon.

SUMMARY OF THE INVENTION

An embodiment of the disclosure comprises a set of wall-based mounting brackets that are secured to a linear wall surface, and which enable an inner support assembly to attach, and hang there from. The inner support assembly is configured to secure and support an object thereon, and is able to attach to a linear wall surface.

These together with additional objects, features and advantages of the wall mounted bracket support system will be readily apparent to those of ordinary skill in the art upon reading the following detailed description of presently preferred, but nonetheless illustrative, embodiments of the wall mounted bracket support system when taken in conjunction with the accompanying drawings.

In this respect, before explaining the current embodiments of the wall mounted bracket support system in detail, it is to be understood that the wall mounted bracket support system is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the wall mounted bracket support system.

It is therefore important that the claims be regarded as including such equivalent construction insofar as they do not depart from the spirit and scope of the wall mounted bracket support system. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
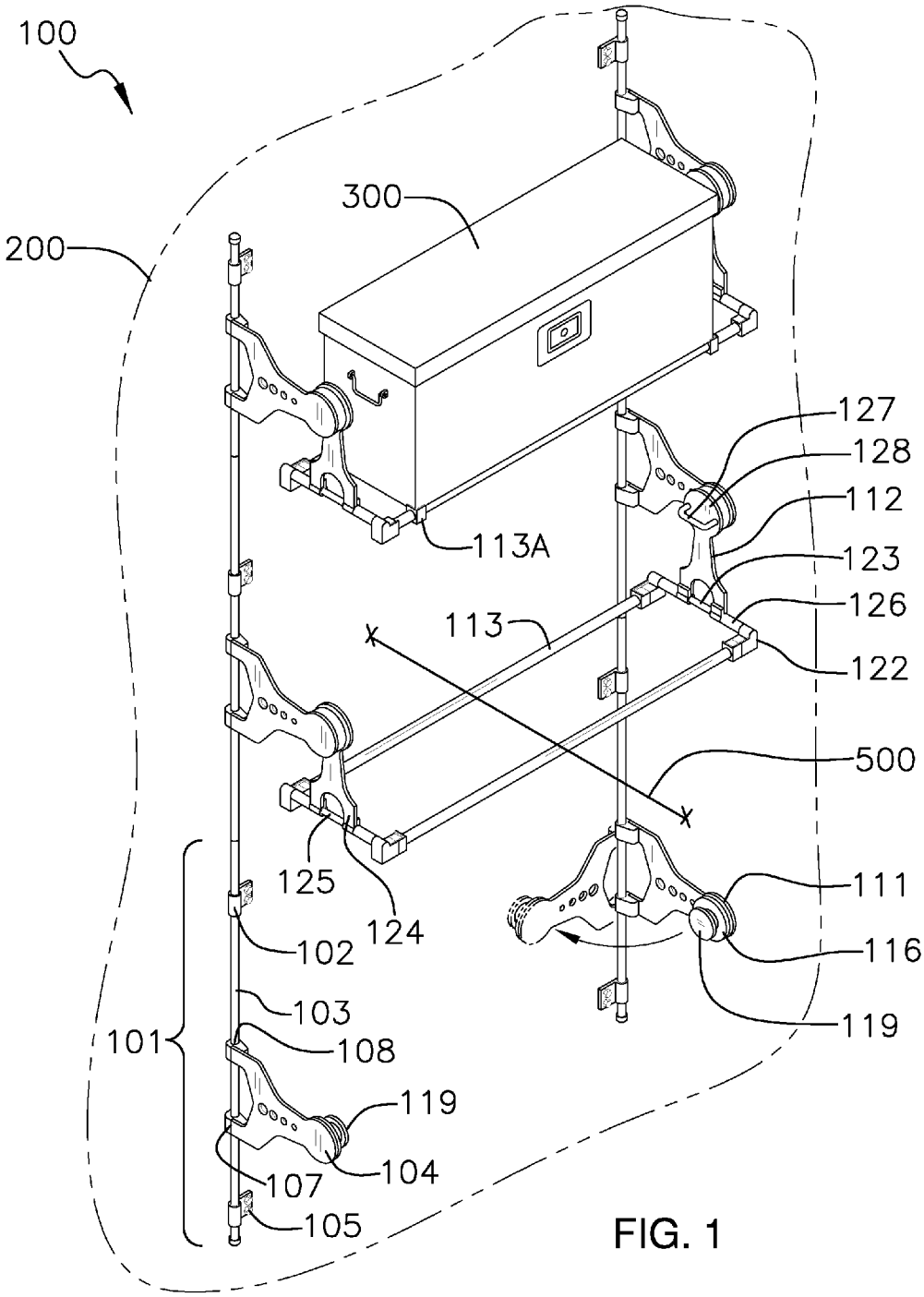
FIG. 1 is a top, perspective view of the wall mounted bracket support system.
Figure 2:
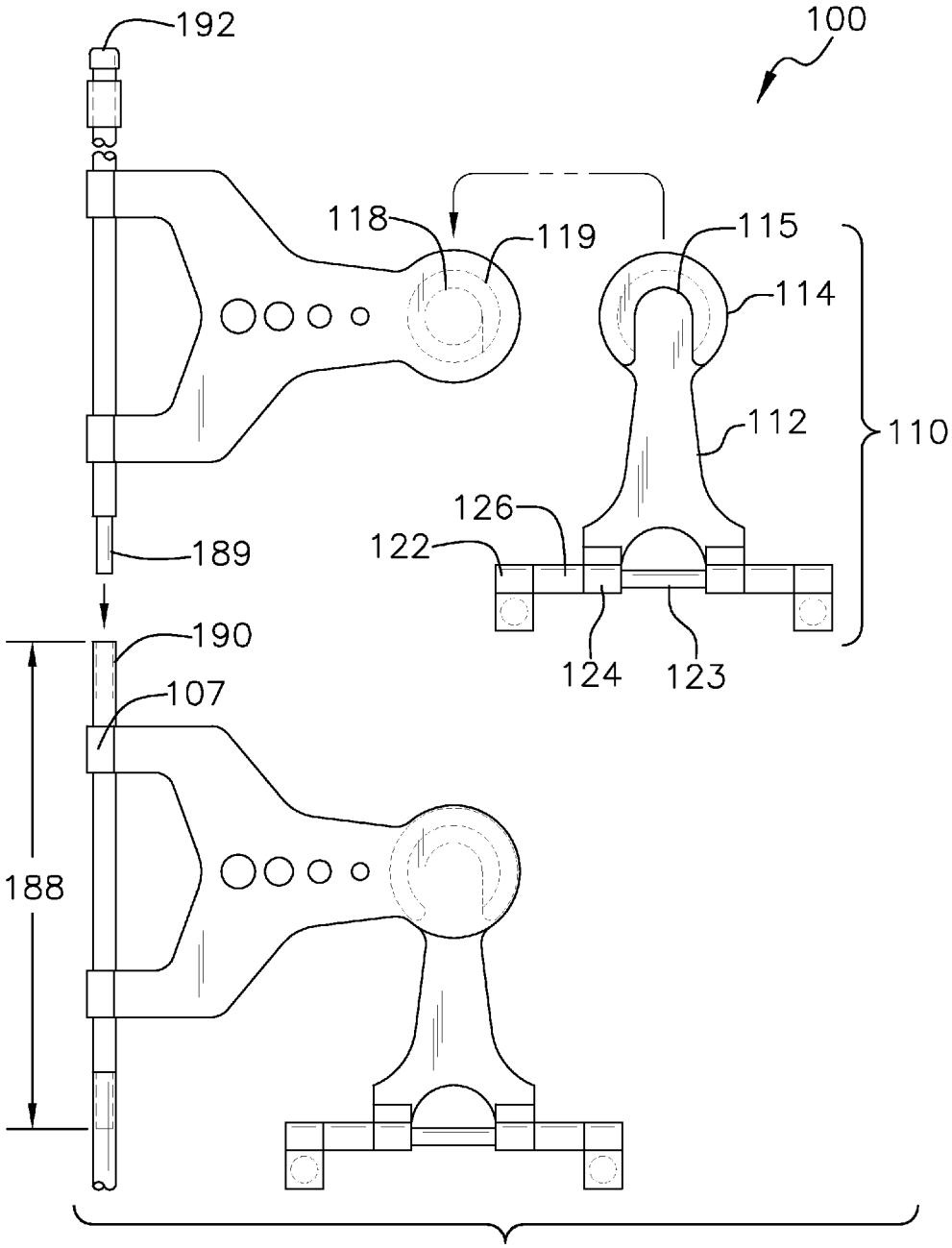
FIG. 2 is a side view of the wall mounted bracket support system.
Figure 3:
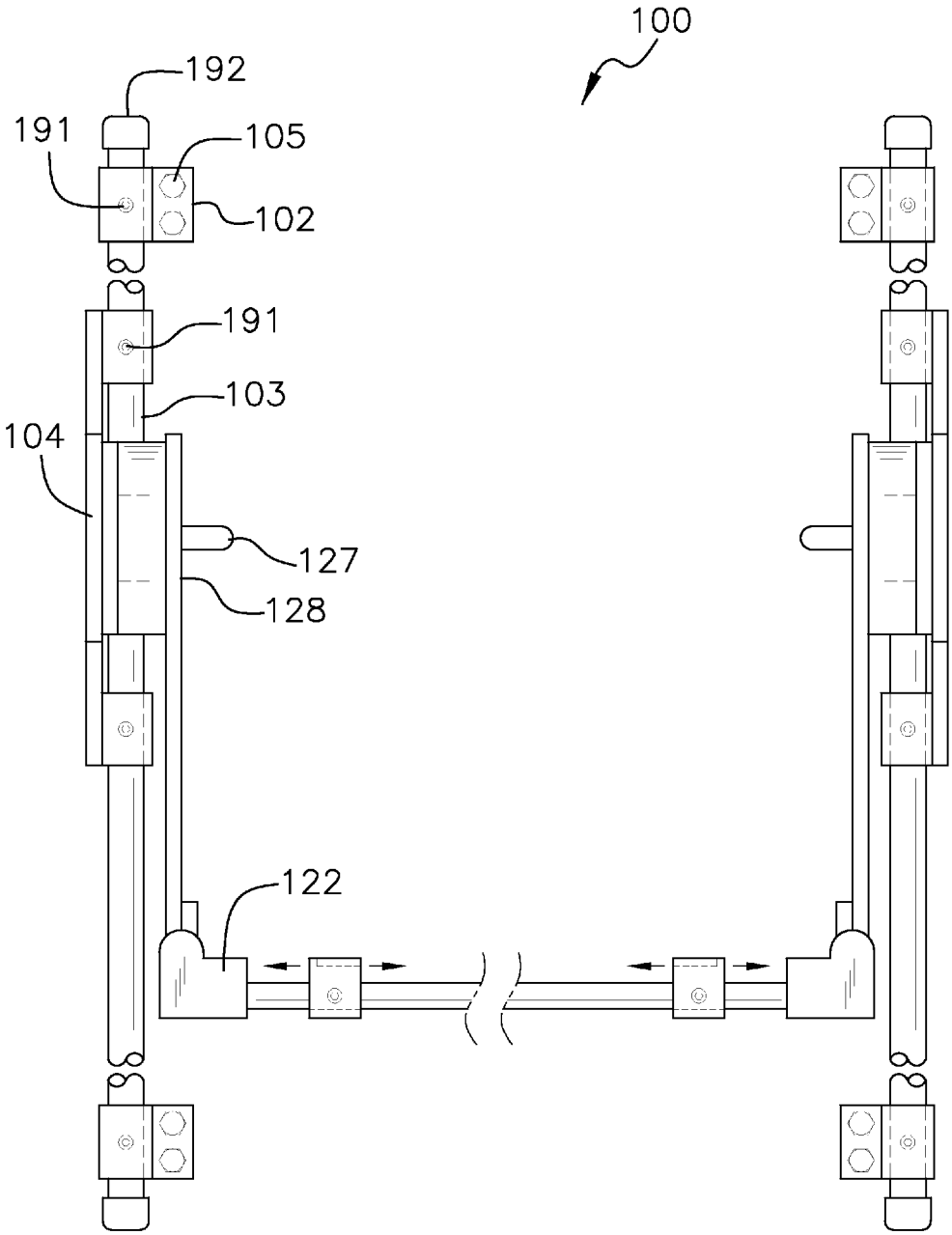
FIG. 3 is a front view of the wall mounted bracket support system.
Figure 4:
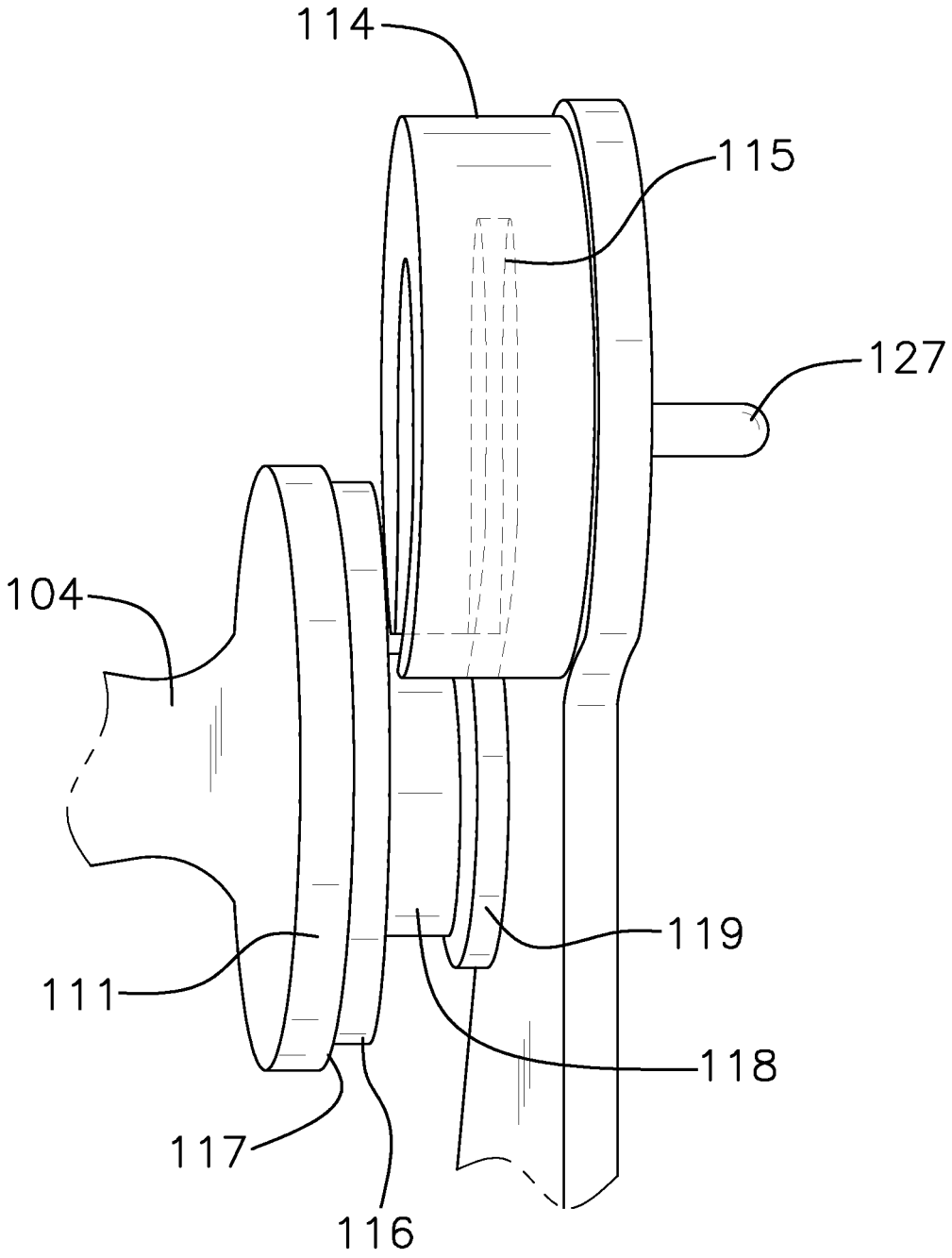
FIG. 4 is a detail view of the pivot bracket adjacent the lock pin and outer support plate.
Figure 5:
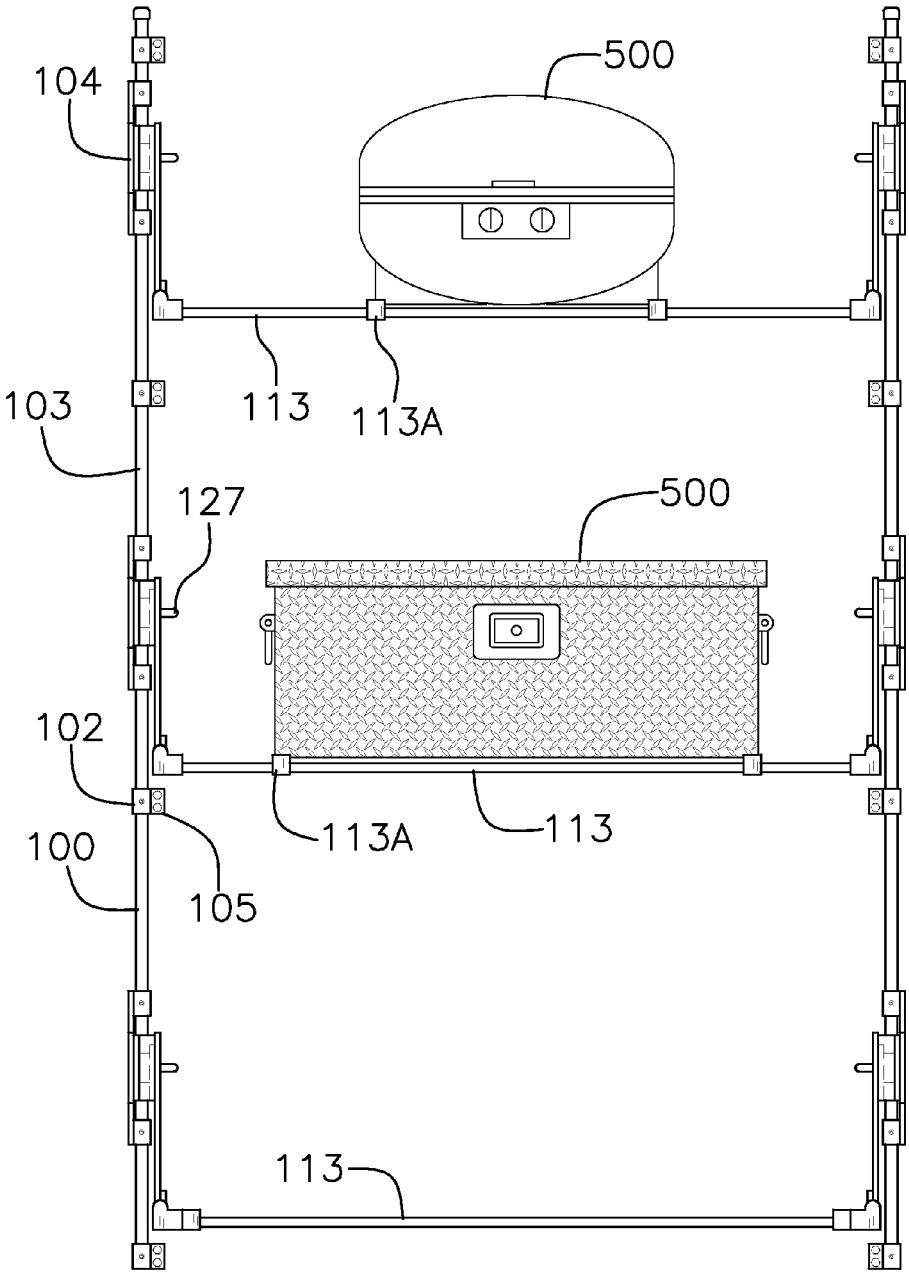
FIG. 5 is a front view of the wall mounted bracket support system in use, and storing different objects.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

As best illustrated in FIGS. 1 through 5, the wall mounted bracket support system 100 (hereinafter invention) is further comprised of an outer support assembly 101 that includes two outer mounting brackets 102 from which an outer bar member 103 attaches. An outer support plate 104 is pivotably attached to the outer bar member 103 such that the outer support plate 104 is able to rotate from a prone or parallel orientation with a linear surface 200.

The outer mounting brackets 102 are rigidly affixed to the linear surface 200 via fastening members 105 that comprise bolts, screws, rivets, etc. The outer support plate 104 includes outer support plate armatures 107 that include armatures holes 108 for pivotable connection with the outer bar member 103. The distal end 111 of the outer support plate 104 has a generally circular shape, which will be explained further below.

An inner support assembly 110 is able to attach onto or detach from the outer support assembly 101. The inner support assembly 110 is further defined with inner support plates 112 located at distal ends of the inner support assembly 110. Moreover, the inner support assembly 110 includes inner support members 113 that span in between the inner support plates 112. The inner support members 113 are each further defined with adjustable mounting blocks 113A that are configured to secure an object 300 atop of the inner support members 113. Moreover, the adjustable mounting blocks 113A are slideably engaged along the inner support members 113 so that the inner support assembly 110 is able to adapt to different shapes and sizes and types of objects 300.

The pivot bracket 114 is a circularly-shaped object with a receiving shoulder 115 that enables the pivot bracket 114 to be seated atop of the distal end 111 of the outer support plate 104.

A pin lock plate 116 rests against an inner surface 117 of the outer support plate 104. The pin lock plate 116 includes a pin lock armature 118 that extends inwardly towards a centerline 500 where a pin lock shoulder 119 is provided. The receiving shoulder 115 of the pivot bracket 114 is uniquely shaped and designed to fit onto the pin lock shoulder 119 such that the inner support assembly 110 is able to pivot with respect to the outer support assembly 101.

The inner support assembly 110 includes inner support brackets 122 that connect the inner support plates 112 to the inner support members 113. Moreover, the inner support brackets 122 include an inner bar member 123 that spans in between two adjacent inner support brackets 122. The inner support plates 112 include inner armatures 124 with inner armature holes 125 that enable the inner support plates 112 to rotate with respect to the inner bar member 123. Collar members 126 are included and span in between the inner support brackets 122 and the inner armatures 124. Moreover, the collar members 126 ensure that the inner support plates 112 do not slide back and forth between the inner support members 113. The collar members 126 are concentrically fitted over the inner bar member 123. The inner armatures 124 include inner armature holes that enable the inner support plates 112 to fold to a prone position with respect to the inner support members 113 such that the inner support assembly 110 is able to collapse when not in use.

The inner support plates 112 each include handles 127 that are oriented inwardly towards the centerline 500 such that the inner support assembly 110 is able to be lifted and removed from the outer support assembly 101. Moreover, the handles 127 are located on an inner surface 128 of the inner support plates 112.

The invention 100 is able to be scaled up or down in use. Moreover, the outer bar member 103 is of an undefined bar member length 188. The outer bar member 103 includes a first outer bar member distal end 189 and a second outer bar member distal end 190. The first outer bar member distal end 189 is able to slide into and connect with the second outer bar member distal end 190 of an adjacent outer bar member 103 such that multiple outer support assemblies 101 may be arranged linearly with respect to the linear surface 200. It shall be noted that the outer mounting brackets 102 may utilize a setscrew 191 to lock the outer bar member 103 in place with respect to the outer mounting bracket 102. Also, the outer bar member 103 may include an end cap 192 to further prevent separation of the outer mounting bracket 102. The outer support plate 104 may utilize setscrews 191 to secure the outer support plate 104 with respect to the outer bar member 103.

Figure 6:
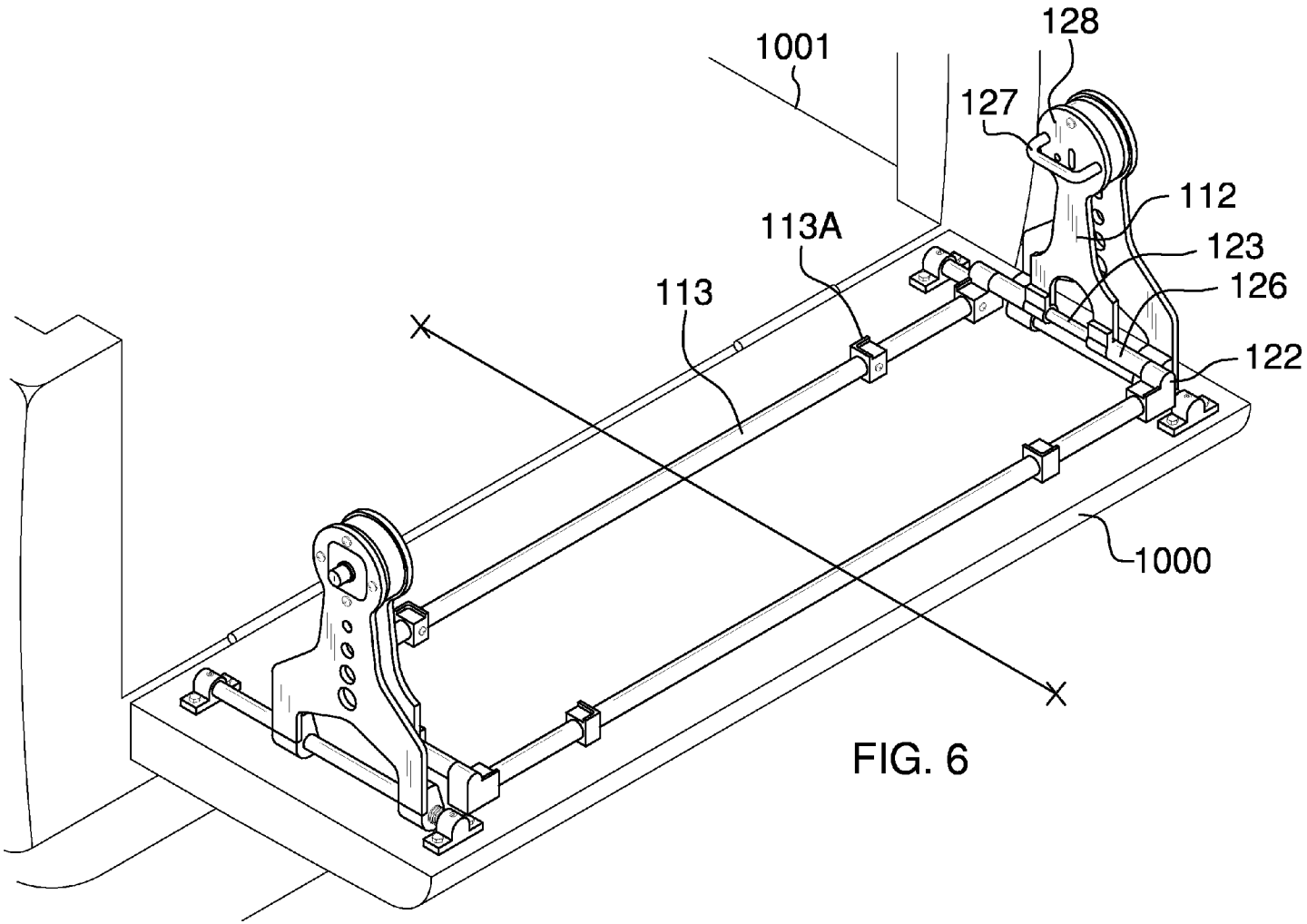
FIG. 6 is a perspective view of the swiveling tailgate support system of a prior filed patent application, and from which priority is being claimed.

It shall be noted that the invention 100 is a device used to store objects 500 adjacent the linear surface 200. More importantly, the invention 100 is used when the object 500 is not be stored adjacent a tailgate 1000 of a pickup truck 1001 as is depicted and defined with the prior filed patent application of which priority is being claimed herein (see FIG. 6).

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A wall mounted bracket support system comprising:

at least one outer support assembly that is configured to secure itself onto a linear surface;

wherein an inner support assembly is configured to store an object thereon;

wherein the inner support assembly is able to hang onto and detach from the outer support assembly as needed for storage purposes;

wherein the outer support assembly includes two outer mounting brackets from which an outer bar member attaches;

wherein an outer support plate is pivotably attached to the outer bar member such that the outer support plate is able to rotate from a prone or parallel orientation with a linear surface;

wherein the outer mounting brackets are rigidly affixed to the linear surface via fastening members that comprise bolts, screws, or rivets;

wherein the outer support plate includes outer support plate armatures that include armatures holes for pivotable connection with the outer bar member; wherein the distal end of the outer support plate has a generally circular shape;

wherein an inner support assembly attaches onto or detaches from the outer support assembly; wherein the inner support assembly is further defined with inner support plates located at distal ends of the inner support assembly; wherein the inner support assembly includes inner support members that span in between the inner support plates;

wherein the inner support members are each further defined with adjustable mounting blocks that are configured to secure an object atop of the inner support members;

wherein the adjustable mounting blocks are slideably engaged along the inner support members so that the inner support assembly is able to adapt to different shapes and sizes and types of objects;

wherein a pivot bracket is a circularly-shaped object with a receiving shoulder that enables the pivot bracket to be seated atop of the distal end of the outer support plate;

wherein a pin lock plate rests against an inner surface of the outer support plate; wherein the pin lock plate includes a pin lock armature that extends inwardly towards a centerline where a pin lock shoulder is provided; wherein the receiving shoulder of the pivot bracket is uniquely shaped and designed to fit onto the pin lock shoulder such that the inner support assembly is able to pivot with respect to the outer support assembly.

2. The wall mounted bracket support system according to claim 1 wherein the inner support assembly includes inner support brackets that connect the inner support plates to the inner support members; wherein the inner support brackets include an inner bar member that spans in between two adjacent inner support brackets; wherein the inner support plates include inner armatures with inner armature holes that enable the inner support plates to rotate with respect to the inner bar member.

3. The wall mounted bracket support system according to claim 2 wherein collar members are included and span in between the inner support brackets and the inner armatures; wherein the collar members ensure that the inner support plates do not slide back and forth between the inner support members; wherein the collar members are concentrically fitted over the inner bar member; wherein the inner armatures include inner armature holes that enable the inner support plates to fold to a prone position with respect to the inner support members such that the inner support assembly is able to collapse when not in use.

4. The wall mounted bracket support system according to claim 3 wherein the inner support plates each include handles that are oriented inwardly towards the centerline such that the inner support assembly is able to be lifted and removed from the outer support assembly;

wherein the handles are located on an inner surface of the inner support plates.

5. The wall mounted bracket support system according to claim 4 wherein the outer bar member is of an undefined bar member length; wherein the outer bar member includes a first outer bar member distal end and a second outer bar member distal end; wherein the first outer bar member distal end is able to slide into and connect with the second outer bar member distal end of an adjacent outer bar member such that multiple outer support assemblies are arranged linearly with respect to the linear surface; wherein the outer mounting brackets utilize a setscrew to lock the outer bar member in place with respect to the outer mounting bracket; wherein the outer bar member includes an end cap to further prevent separation of the outer mounting bracket; wherein the outer support plate utilizes setscrews to secure the outer support plate with respect to the outer bar member.

6. A wall mounted bracket support system comprising:

at least one outer support assembly that is configured to secure itself onto a linear surface;

wherein an inner support assembly is configured to store an object thereon;

wherein the inner support assembly is able to hang onto and detach from the outer support assembly as needed for storage purposes;

wherein the outer support assembly includes two outer mounting brackets from which an outer bar member attaches;

wherein an outer support plate is pivotably attached to the outer bar member such that the outer support plate is able to rotate from a prone or parallel orientation with a linear surface;

wherein the outer mounting brackets are rigidly affixed to the linear surface via fastening members that comprise bolts, screws, or rivets;

wherein the outer support plate includes outer support plate armatures that include armatures holes for pivotable connection with the outer bar member; wherein the distal end of the outer support plate has a generally circular shape;

wherein an inner support assembly attaches onto or detaches from the outer support assembly; wherein the inner support assembly is further defined with inner support plates located at distal ends of the inner support assembly; wherein the inner support assembly includes inner support members that span in between the inner support plates;

wherein the inner support members are each further defined with adjustable mounting blocks that are configured to secure an object atop of the inner support members;

wherein the adjustable mounting blocks are slideably engaged along the inner support members so that the inner support assembly is able to adapt to different shapes and sizes and types of objects; wherein a pivot bracket is a circularly-shaped object with a receiving shoulder that enables the pivot bracket to be seated atop of the distal end of the outer support plate;

wherein a pin lock plate rests against an inner surface of the outer support plate; wherein the pin lock plate includes a pin lock armature that extends inwardly towards a centerline where a pin lock shoulder is provided; wherein the receiving shoulder of the pivot bracket is uniquely shaped and designed to fit onto the pin lock shoulder such that the inner support assembly is able to pivot with respect to the outer support assembly.

7. The wall mounted bracket support system according to claim 6 wherein the inner support assembly includes inner support brackets that connect the inner support plates to the inner support members; wherein the inner support brackets include an inner bar member that spans in between two adjacent inner support brackets; wherein the inner support plates include inner armatures with inner armature holes that enable the inner support plates to rotate with respect to the inner bar member; wherein collar members are included and span in between the inner support brackets and the inner armatures; wherein the collar members ensure that the inner support plates do not slide back and forth between the inner support members; wherein the collar members are concentrically fitted over the inner bar member; wherein the inner armatures include inner armature holes that enable the inner support plates to fold to a prone position with respect to the inner support members such that the inner support assembly is able to collapse when not in use.

8. The wall mounted bracket support system according to claim 7 wherein the inner support plates each include handles that are oriented inwardly towards the centerline such that the inner support assembly is able to be lifted and removed from the outer support assembly; wherein the handles are located on an inner surface of the inner support plates.

9. The wall mounted bracket support system according to claim 8 wherein the outer bar member is of an undefined bar member length; wherein the outer bar member includes a first outer bar member distal end and a second outer bar member distal end; wherein the first outer bar member distal end is able to slide into and connect with the second outer bar member distal end of an adjacent outer bar member such that multiple outer support assemblies are arranged linearly with respect to the linear surface; wherein the outer mounting brackets utilize a setscrew to lock the outer bar member in place with respect to the outer mounting bracket; wherein the outer bar member includes an end cap to further prevent separation of the outer mounting bracket; wherein the outer support plate utilizes setscrews to secure the outer support plate with respect to the outer bar member.

* * * * *